US008915722B1

(12) United States Patent
Blume

(10) Patent No.: US 8,915,722 B1
(45) Date of Patent: Dec. 23, 2014

(54) INTEGRATED FLUID END

(76) Inventor: George H. Blume, Lakeway, TX (US)

( * ) Notice: Subject to any disclaimer, the term of this patent is extended or adjusted under 35 U.S.C. 154(b) by 286 days.

(21) Appl. No.: 13/385,960

(22) Filed: Mar. 16, 2012

Related U.S. Application Data

(63) Continuation-in-part of application No. 12/390,517, filed on Feb. 23, 2009, now Pat. No. 8,147,227.

(51) Int. Cl.

| | |
|---|---|
| ***F04B 39/00*** | (2006.01) |
| ***F04B 7/00*** | (2006.01) |
| ***F04B 53/10*** | (2006.01) |
| ***F16K 27/00*** | (2006.01) |

(52) U.S. Cl.
USPC ..... 417/454; 417/510; 417/559; 417/DIG. 1; 137/543.23; 251/359; 251/365

(58) Field of Classification Search
CPC ..... F04B 53/102; F04B 53/1022; F04B 53/1032; F04B 53/108; F04B 53/1087; F04B 53/22; F04B 53/1025; F04B 39/1013; F16K 1/42; F16K 1/34
USPC ..... 417/454, 510, 559, 563, 567, DIG. 1, 417/415; 29/888.02; 137/543.23; 251/359, 251/262, 365
See application file for complete search history.

(56) References Cited

U.S. PATENT DOCUMENTS

| | | | | | |
|---|---|---|---|---|---|
| 1,947,071 | A | * | 2/1934 | Walton | 251/172 |
| 1,948,628 | A | | 2/1934 | Penick et al. | 251/332 |
| 2,236,370 | A | | 3/1941 | Jackman | 277/531 |
| 2,257,417 | A | | 9/1941 | Kelley | 123/193.3 |
| 2,316,480 | A | * | 4/1943 | White et al. | 137/541 |
| 2,559,659 | A | | 7/1951 | Redman | 417/568 |
| 2,918,078 | A | * | 12/1959 | Cummings | 137/332 |
| 3,053,500 | A | | 9/1962 | Atkinson | 251/332 |
| 3,186,430 | A | | 6/1965 | Koutnik | 137/516.29 |
| 3,191,617 | A | | 6/1965 | Maddox | 137/516.29 |
| 3,510,103 | A | | 5/1970 | Carsello | 251/333 |
| 3,598,145 | A | | 8/1971 | Wolfson | 251/360 |
| 3,809,362 | A | | 5/1974 | Baumann | 251/332 |
| 3,905,608 | A | | 9/1975 | Olsen et al. | 277/584 |
| 4,084,606 | A | | 4/1978 | Mittleman | 137/102 |
| 4,373,550 | A | | 2/1983 | Yelich | 137/516.29 |
| 4,456,440 | A | | 6/1984 | Korner | 417/540 |
| 4,467,703 | A | | 8/1984 | Redwine et al. | 137/516.29 |
| 4,474,208 | A | | 10/1984 | Looney | 137/516.29 |
| 4,477,236 | A | | 10/1984 | Elliott | 417/454 |
| 4,508,133 | A | | 4/1985 | Hamid | 137/68 |
| 4,527,961 | A | | 7/1985 | Redwine et al. | 417/454 |
| 4,573,886 | A | | 3/1986 | Maasberg et al. | 417/454 |
| 4,696,321 | A | | 9/1987 | Reese et al. | 251/80 |

(Continued)

*Primary Examiner* — Bryan Lettman
*Assistant Examiner* — Timothy P Solak
(74) *Attorney, Agent, or Firm* — Chris Whewell

(57) ABSTRACT

Tapered valve guide and spring retainer assemblies are described for use in plunger pump housings that incorporate corresponding outwardly flared discharge and suction bores, as well as structural features for stress-relief. Plunger pumps so constructed are relatively resistant to fatigue failure because of stress reductions, and they may incorporate essentially any style of valves, including top and lower stem-guided valves and crow-foot-guided valves, in easily-maintained configurations. Besides forming a part of valve guide and spring retainer assemblies, side spacers may be shaped and dimensioned to improve volumetric efficiency of the pumps in which they are used. The present disclosure provides, for the first time, the use of tungsten carbide valve seats, which significantly increase durability and service life of a pump, especially when abrasive fluids are being pumped, as in various oilfield operations.

19 Claims, 11 Drawing Sheets

(56) References Cited

U.S. PATENT DOCUMENTS

| | | | | | |
|---|---|---|---|---|---|
| 4,714,237 | A | | 12/1987 | Linderman et al. | 251/362 |
| 4,766,927 | A | * | 8/1988 | Conatser | 137/315.27 |
| 4,768,933 | A | | 9/1988 | Stachowiak | 417/454 |
| 4,770,206 | A | | 9/1988 | Sjoberg | 137/902 |
| 4,771,801 | A | | 9/1988 | Crump et al. | 137/68.26 |
| 4,773,833 | A | | 9/1988 | Wilkinson et al. | 417/539 |
| 4,878,815 | A | | 11/1989 | Stachowiak | 417/63 |
| 4,915,354 | A | | 4/1990 | Sims et al. | 251/334 |
| 5,020,809 | A | | 6/1991 | Mullaney | 277/370 |
| 5,060,374 | A | | 10/1991 | Findlanl et al. | 29/890.128 |
| 5,145,340 | A | | 9/1992 | Allard | 417/568 |
| 5,226,445 | A | | 7/1993 | Surjaatmadja | 137/516.29 |
| 5,247,960 | A | | 9/1993 | Kornfeldt et al. | 251/360 |
| 5,375,813 | A | | 12/1994 | Rozinsky | 251/333 |
| 5,622,486 | A | | 4/1997 | McDuffie et al. | 417/536 |
| 5,839,468 | A | * | 11/1998 | Allred | 137/454.4 |
| 5,924,853 | A | | 7/1999 | Pacht | 417/567 |
| 6,176,692 | B1 | * | 1/2001 | Reinartz et al. | 417/454 |
| 6,241,492 | B1 | | 6/2001 | Pacht | 417/567 |
| 6,264,441 | B1 | | 7/2001 | Marioni | 417/423.1 |
| 6,267,383 | B1 | | 7/2001 | Morvant | 277/439 |
| 6,298,817 | B1 | | 10/2001 | Hoeg | 123/188.3 |
| 6,517,049 | B2 | * | 2/2003 | Coppock | 251/329 |
| 6,623,259 | B1 | * | 9/2003 | Blume | 417/559 |
| 7,364,412 | B2 | | 4/2008 | Kugelev et al. | 417/454 |
| 2002/0079332 | A1 | | 6/2002 | McIntire et al. | 222/189.06 |
| 2002/0096217 | A1 | | 7/2002 | Wu et al. | 137/543.19 |
| 2003/0132415 | A1 | | 7/2003 | Chigasaki et al. | 251/368 |
| 2008/0041439 | A1 | * | 2/2008 | Achutharaman et al. | 136/244 |
| 2011/0206546 | A1 | * | 8/2011 | Vicars | 417/559 |

* cited by examiner

INTEGRATED FLUID END

CROSS REFERENCE TO RELATED APPLICATIONS

This application is a continuation-in-part of, and claims the benefit of U.S. patent application Ser. No. 12/390,517 filed on Feb. 23, 2009 now U.S. Pat. No. 8,147,227, the entire contents of which is hereby incorporated herein by reference thereto.

TECHNICAL FIELD

The present disclosure generally concerns high-pressure plunger-type pumps useful, for example, in oil field operations. More particularly, the invention relates to fluid sections of such pumps and features provided thereto which impart heretofore unseen longevity and durability to such pumps when subjected to extreme service, including pumping of abrasive fluid materials.

BACKGROUND OF THE INVENTION

The statements in this background section merely provide background information related to the present disclosure and may not constitute prior art.

Engineers typically design high-pressure plunger pumps useful in oilfield operations in two sections; a (proximal) power section and a (distal) fluid section. The power section typically comprises a crankshaft, reduction gears, bearings, connecting rods, crossheads, crosshead extension rods, etc. Common fluid sections usually comprise a plunger pump housing (a.k.a. block) having a suction valve in a suction bore, a discharge valve in a discharge bore, a plunger in a plunger bore, and an access bore, as well as high-pressure seals, gaskets, retainers, and ancillary hardware.

Valve terminology can vary according to the industry (e.g., pipeline or oil field service) in which a valve is used. In some applications, the term "valve" means just the moving element or valve body. In the present application, the term "valve" may be used in a general sense as appropriate for the context and can include components other than the valve body, e.g., various valve guides, valve seats, and/or one or more valve springs and/or valve inserts (seals).

In FIG. 1 there is shown a cross-sectional schematic view of a typical fluid section of a plunger pump showing its connection to a power section by stay rods. A plurality of fluid sections similar to that illustrated in FIG. 1 may be combined, as suggested in the Triplex fluid section housing schematically illustrated in FIG. 2, such pumps having multiple fluid sections being well-known.

Each individual bore in a plunger pump housing is subject to fatigue due to alternating high and low pressures which occur with each stroke of the plunger cycle. Conventional plunger pump housings frequently fail due to fatigue cracks in one or more areas defined by the intersecting suction, plunger, access and discharge bores, as illustrated in FIG. 3. Towards reduction of fatigue cracking in high pressure plunger pump housings described above, Y-block housing designs exemplified by that shown schematically illustrated in FIG. 4A have been proposed. The Y-block design reduces stress concentrations in a plunger pump housing such as those shown in FIGS. 1 and 3 by increasing the angles of bore intersections above 90°. In the example illustrated in FIG. 4A, the bore intersection angles are approximately 120°. A more complete cross-sectional view of a Y-block plunger pump fluid section is schematically illustrated in FIG. 4B.

Although several variations of the Y-block design have been evaluated, few, if any, have become commercially successful for several reasons. One reason is that mechanics find field maintenance on Y-block fluid sections difficult. For example, replacement of plungers and/or plunger packing is significantly more complicated in Y-block designs than in the earlier designs represented by FIG. 1. In the earlier designs, provision is made to push the plunger distally through the plunger bore and out through an access bore (see, e.g., FIG. 3). This operation, which would leave the plunger packing easily accessible from the proximal end of the plunger bore, is not possible in a Y-block design. Thus, a Y-block configuration, while reducing stress in plunger pump housings relative to earlier designs, is associated with significant disadvantages, such as cracks as shown in FIG. 4A.

Advances in high pressure plunger pump housings that provide both improved internal access and superior stress reduction are expressed in U.S. Pat. Nos. 6,623,259, 6,544,012 and 6,382,940, which are incorporated herein by reference. One embodiment of a right angular plunger pump such as that described in U.S. Pat. No. 6,623,259 (the '259 patent) is schematically illustrated in FIG. 5. It includes a right-angular plunger pump housing 12 comprising a suction bore 3, discharge bore 5, plunger bore 7, and access bore 9. Suction bore 3 and discharge bore 5 are each internally fitted with a valve that permits fluid flow in one direction only, such that when plunger 11 is withdrawn from housing 12 during normal pump operation, a reduced pressure zone is created substantially in the center of housing 12, enabling ambient pressure to cause suction valve 13 to open, thus admitting a fluid that is desired to be pumped to enter the interior of housing 12. Once a material that is desired to be pumped is present within housing 12 and plunger 11 is moved into housing 12 following its withdrawal during an operation cycle, pressure created by such action causes suction valve 13 to close upon its seat 15 whilst simultaneously causing discharge valve 17 to be moved from discharge valve seat 19, enabling material flow through discharge bore 5 and out of housing 12, during such normal operation of a plunger pump. The suction bore 3 and discharge bore 5 each include a portion having substantially-circular cross-sections for accommodating, e.g., a valve seat. Suction and discharge bores 3, 5 that accommodate valve seats 15, 19 are sometimes slightly conically-shaped to facilitate the secure and substantial leak-proof fitment of each valve seat within a bore of pump housing 12 (e.g., by press-fitting a valve seat that has an interference fit with the pump housing). Less commonly, the portions of suction and discharge bores intended to accommodate a valve seat are cylindrical instead of being slightly conical. Further, each bore (i.e., suction, discharge, access and plunger bores) comprises a transition area which interfaces with other bore transition areas.

The plunger bore 7 of the right-angular plunger pump housing of FIG. 5 comprises a plunger bore having a proximal packing area (i.e., an area relatively nearer the power section) and a distal transition area (i.e., an area relatively more distant from the power section). Between the packing and transition areas is a right circular cylindrical area for accommodating a plunger. The transition area of the plunger bore facilitates interfaces with analogous transition areas of other bores as noted above.

Each bore transition area of the right-angular pump housing of FIG. 5 has a stress-reducing feature comprising an elongated (e.g., elliptical or oblong) cross-section that is substantially perpendicular to each respective bore's longitudinal axis. Intersections of the bore transition areas are typically chamfered, the chamfers comprising additional stress-reducing features. Further, the long axis of each such elongated cross-section is substantially perpendicular to a plane that contains, or is parallel to, the longitudinal axes of the suction, discharge, access and plunger bores.

An elongated suction bore transition area, as described in the '259 patent, can simplify certain plunger pump housing structural features needed for installation of a suction valve. Specifically, the valve spring retainer of a suction valve installed in such a plunger pump housing does not require a retainer arm projecting from the housing. Nor do threads have to be cut in the housing to position the retainer that secures the suction valve seat. Benefits arising from the absence of a suction valve spring retainer arm include stress reduction in the plunger pump housing and simplified machining requirements. Further, the absence of threads associated with a suction valve seat retainer in the suction bore eliminates the stress-concentrating effects that would otherwise be associated with such threads, as shown in the Y-block of FIG. 4B, which denotes the high stress concentrations in the threads.

Threads can be eliminated from the suction bore if the suction valve seat is inserted via the access bore and the suction bore transition area and press-fit into place as described in the '259 patent. Following this, the suction valve body can also be inserted via the access bore and the suction bore transition area. Finally, a valve spring is inserted via the access bore and the suction bore transition area and held in place by a similarly-inserted oblong suction valve spring retainer, an example of which is described in the '259 patent. The '259 patent illustrates an oblong suction valve spring retainer having a guide hole (for a top-stem-guided valve body), as well as an oblong suction valve spring retainer without a guide hole (for a crow-foot-guided valve body). Both of these oblong suction valve spring retainer embodiments are secured in a pump housing of the '259 patent by clamping about an oblong lip, the lip being a structural feature of the housing (see FIG. 5 for a schematic illustration of oblong lip 266 in a right angular plunger pump housing).

The '259 patent also teaches means for mounting discharge valves in the fluid end of a high-pressure pump incorporating positive displacement pistons or plungers. For well service applications both suction and discharge valves typically incorporate a traditional full open seat design with each valve body having integral crow-foot guides. This design has been adapted for the high pressures and repetitive impact loading of the valve body and valve seat that are seen in well service. However, stem-guided valves with full open seats could also be considered for well service because they offer better flow characteristics than traditional crow-foot-guided valves. But in a full open seat configuration stem-guided valves may have guide stems on both sides of the valve body (i.e., "top" and "lower" guide stems) or only on one side of the valve body (e.g., as in top stem guided valves) to maintain proper alignment of the valve body with the valve seat during opening and closing. Conventional valve designs incorporating secure placement of guides for both top and lower valve guide stems have been associated with complex components and difficult maintenance. U.S. Pat. Nos. 6,910,871 and 7,513,759 describe alternative methods and apparati related to valve stem guide and spring retainer assemblies and to plunger pump housings in which they are used. Such plunger pump housings can incorporate one or more of the stress-relief structural features described herein, plus one or more additional structural features associated with use of alternative valve stem guide and spring retainer assemblies in the housings. Such plunger pump housings do not, however, comprise an oblong lip (see, e.g., structure 266 in FIG. 5 as noted above) for securing a suction valve spring retainer. The absence of this oblong lip simplifies machining of the plunger pump housing, and the corresponding design results in reduced stress within the pump housing.

Available seats for plunger-type pumps used in hydraulic fracturing of sub-strata have been standardized by manufacturers and fracturing pump users to promote commonality, increase availability, and reduce costs of these highly expendable components. Standard high-pressure seat designs commonly used in the industry feature seats with a shoulder and a seat taper of 0.75 inches per foot on the diameter. This taper mates with a similar taper in the fluid end. This very "fast" taper is insufficient to retain the seat in a locked position and when the seat is subjected to very high valve loads. Due to such a fast taper, a shoulder is necessary on the seat to prevent the seat from sliding down the taper when the seat is subjected to very high valve loads. Thus, the seat shoulder is exposed to very high downward or axial loads, which results in the very high stresses in the fillet, as further discussed herein. Some pumps designed by Halliburton Inc. feature a taper of 1.5 inches per foot on the diameter of one or more of the bores. While the seats for the Halliburton pumps have no shoulder and the outside taper is continuous, the fluid ends for Halliburton pumps include a shoulder at the very bottom of the bore taper for the purpose of preventing the seat from sliding down the taper. This shoulder results in very high stresses at the fillet at the corner of the fluid end taper and bottom shoulder.

SUMMARY OF THE INVENTION

Fluid end sections typically used in plunger-style pumps comprising a suction bore, a discharge bore, and a plunger bore. At least one and in some embodiments both the suction bore and the discharge bore include a tapered wall portion having a continuous taper with a degree of taper of any degree in the range of between 2 inches per foot and 2.5 inches per foot. The tapered wall portion is configured to receive a valve seat having a tapered outer wall, and the tapered outer wall of the seat(s) present in a fluid end according to embodiments of this disclosure feature a continuous taper.

Fluid end assemblies comprising a fluid end block having a suction bore featuring a tapered wall portion having a region of continuous taper with a degree of taper of any degree in the range of between 2 inches per foot and 2.5 inches per foot. The fluid end block further includes a first valve seat having a tapered outer wall, and the tapered outer wall is substantially the same in taper as the tapered wall portion of the suction bore. The first valve seat is present in the region of continuous taper of the suction bore. There is a discharge bore including a tapered wall portion having a region of continuous taper with a degree of taper of any degree in the range of between 2 inches per foot and 2.5 inches per foot, and a second valve seat having a tapered outer wall. The tapered outer wall is substantially the same in taper as the tapered wall portion of the discharge bore, and the second valve seat is present in the region of continuous taper of the discharge bore. There is a plunger bore, and a plunger moveably disposed within the plunger bore. A valve is moveably disposed in the suction bore, which valve is sealingly engageable with the seat present in the suction bore, and a valve is moveably disposed in the discharge bore, which valve is sealingly engageable with the seat present in the discharge bore.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is in no way intended to limit the present disclosure, application, or uses.

Figure 6:
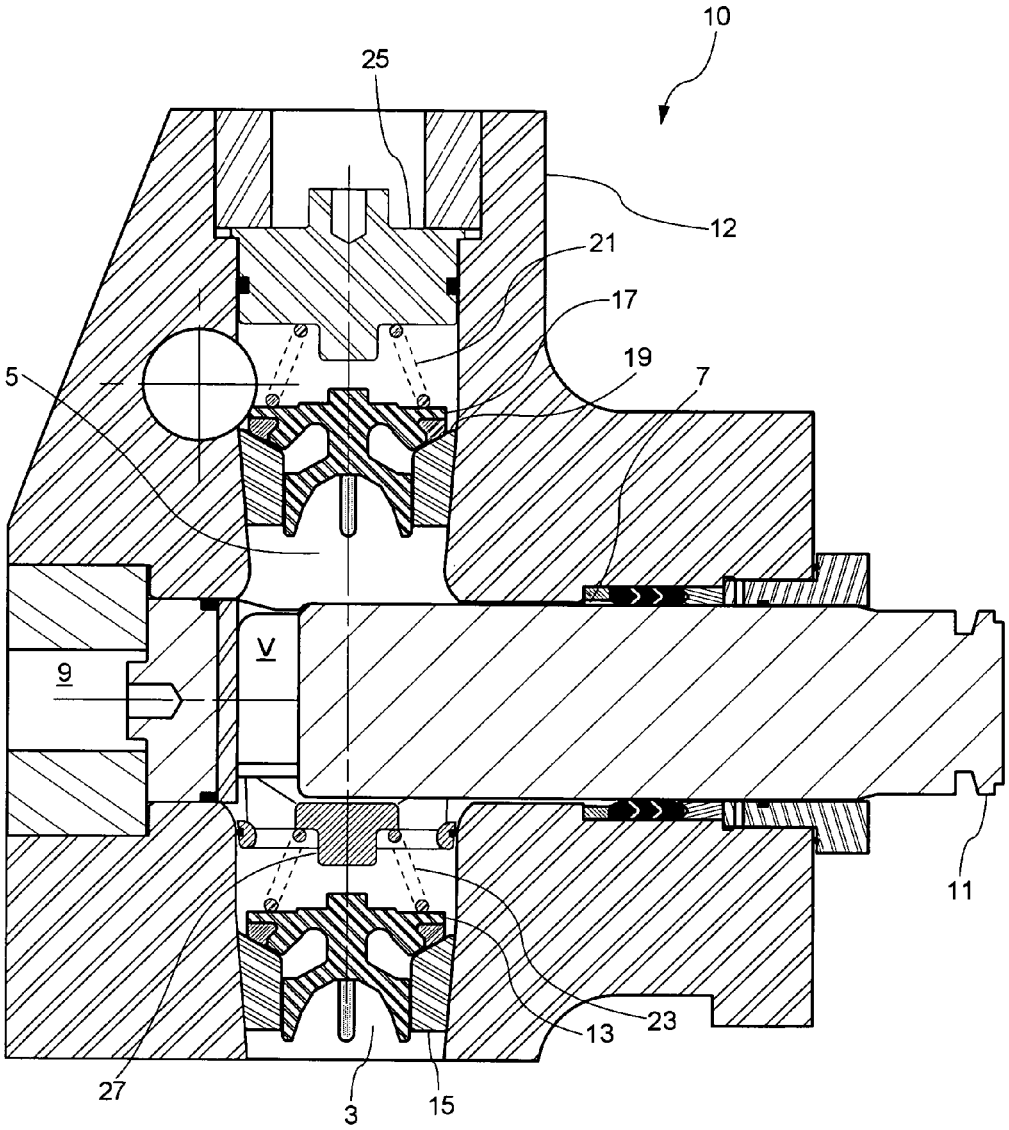
FIG. 6 schematically illustrates a cross-section of a right-angular plunger pump with valves, plunger, and a suction valve spring retainer according to some embodiments of the disclosure.

Referring again to the drawings, and particularly to FIG. 6 there is shown a cross-section of a right-angular plunger pump 10 made using a housing 12, and having suction bore 3, discharge bore 5, access bore 9 suction valve 13, seat 15, discharge valve 17, seat 19, plunger 11 present in a plunger bore 7, inner volume V, suction valve spring 23, suction valve spring retainer 27, discharge valve spring 21, discharge cover and spring retainer 25 according to some embodiments of the disclosure. According to embodiments of the disclosure exemplified by this FIG. 6, valve seats 15, 19 are present in suction bore 3 and discharge bore 5 respectively, so that the outer wall portions of valve seats 15, 19 are entirely present within a tapered portion of suction bore 3 and discharge bore 5. Stated another way, the portions of suction bore 3 and discharge bore 5 at which valve seats 15, 19 are present are tapered, along the entire length of the area of contact between the valve seats 15, 19 and the tapered portions of bores 3, 5. In some embodiments, the taper of the portions of suction bore 3 and discharge bore 5 at or in which valve seats 15, 19 are present is a continuous taper, i.e., the degree of taper per unit length in either one of the bores, and optionally both bores, is constant at all points at which each valve seat contacts the tapered regions within suction bore 3 and discharge bore 5. Thus, in some embodiments the entire valve seat 15, 19 is present in a continuously tapered portion of a bore 3, 5 as shown in FIG. 6. In FIG. 6 the springs and retainers function to provide a mechanical bias to the suction valve and discharge valve, towards a closed position.

Figure 7:
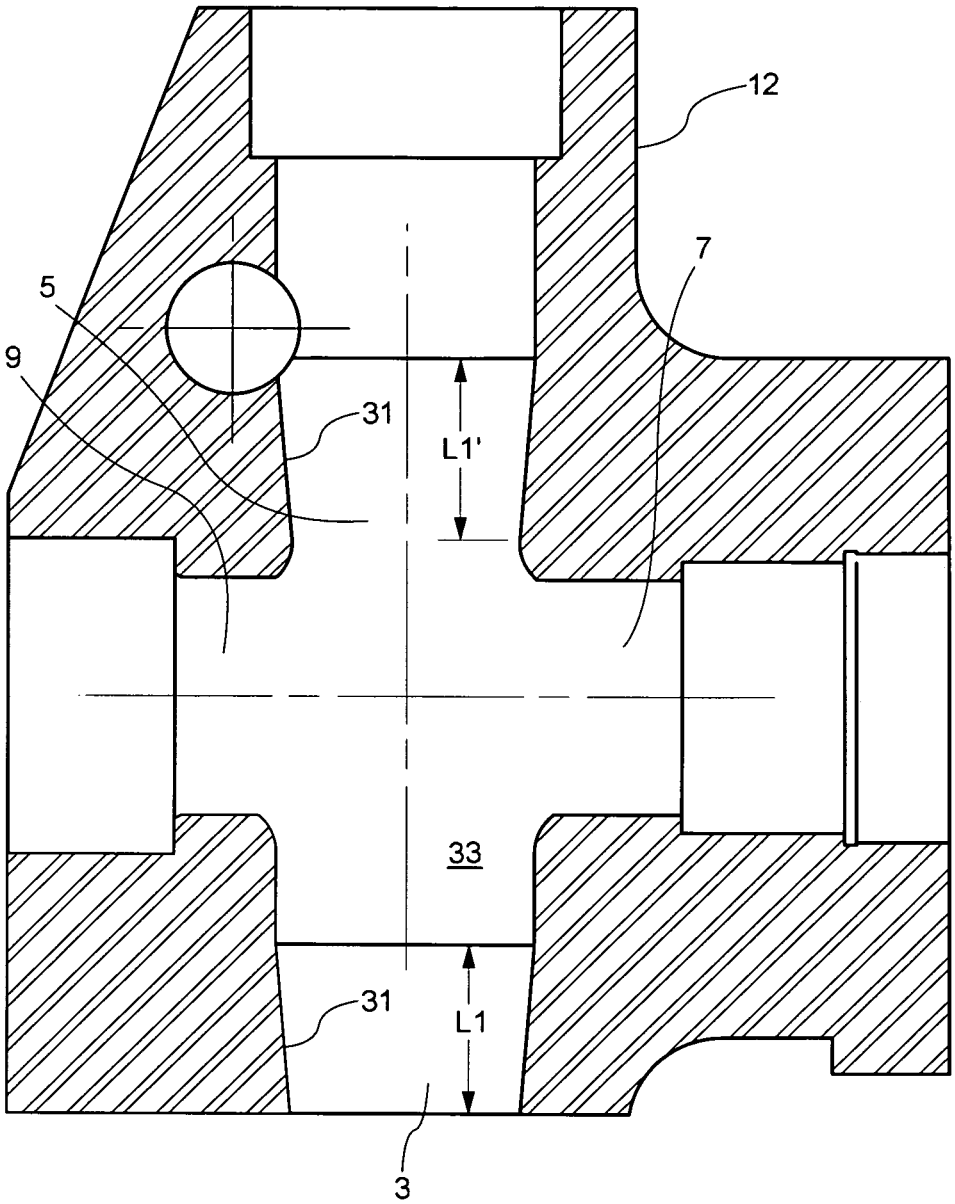
FIG. 7 is a cross-sectional schematic view of suction, plunger, access and discharge bores of a plunger pump housing intersecting at right angles according to some embodiments of the disclosure.

FIG. 7 shows a cross-sectional schematic view of a fluid end housing 12, including its features of suction bore 3, discharge bore 5 which in some embodiments intersect at right angles to plunger bore 7 and access bore 9. Also depicted are tapered wall portions 31 present within suction bore 3 and discharge bore 5. It is within these tapered wall portions 31 that valve seats are disposed, according to some embodiments of the invention.

One aspect of tapered wall portions 31 is the degree or the amount of taper present, expressed one way in terms of inches of taper per foot, that is—how much the diameter of the tapered wall portions 31 change per unit length of the bores 3, 5. According to various embodiments of a pump and pump housing of this disclosure, the degree of taper of a tapered wall portion 31 of or in a plunger pump housing bore is any degree of taper within the range of between 2.000 inches per foot and 2.500 inches per foot, including all degrees of taper and ranges of degrees of taper therebetween, in some embodiments expressed to the nearest thousandth of an inch; however, any selected degree of accuracy within this range is in accordance with this disclosure. I have found tapers within the above range to prevent the seat from seizing against the taper in the housing 12 when the seat is pressed into the taper. Since such a structure lacks a shoulder and a seat deck, the valve load is widely distributed over the seat taper of the suction valve chamber 33 (FIG. 7). Operating stresses at any one point in the area supportive of the valve seat are greatly reduced over prior art structures.

Figure 1:
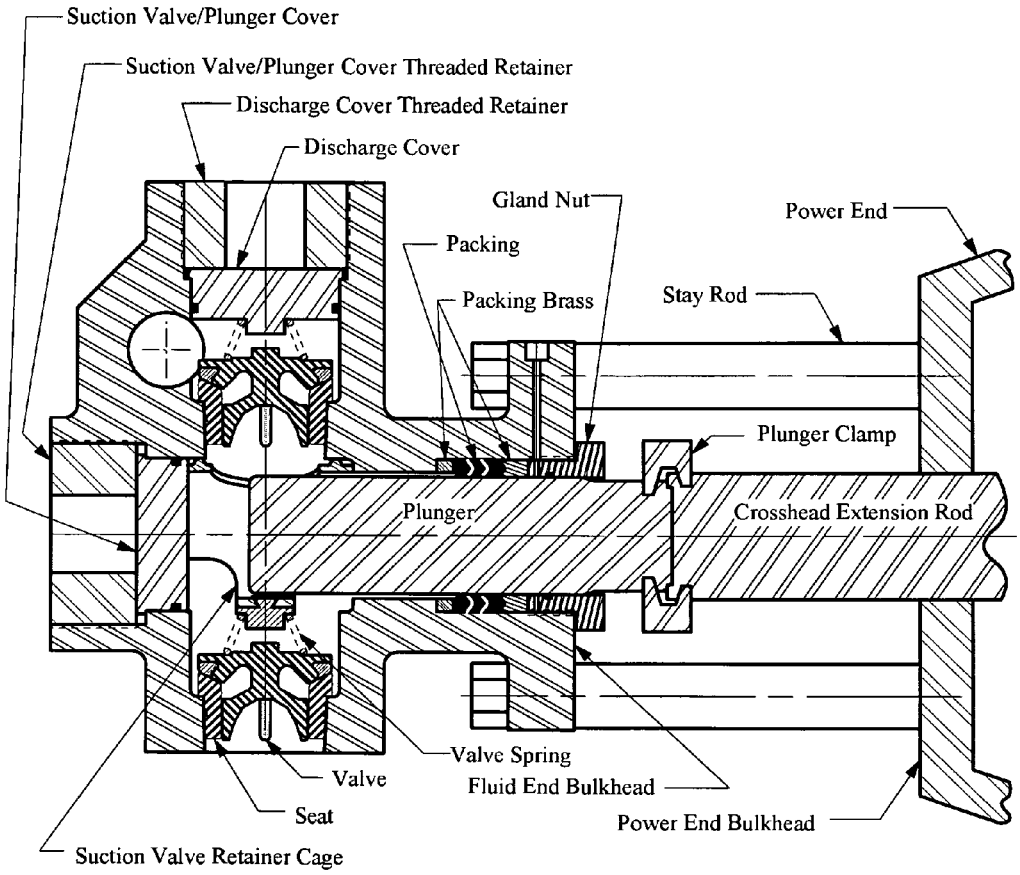
Prior Art Figure 1
FIG. 1 is a cross-sectional schematic view of a typical plunger pump fluid section showing its connection to a power section by stay rods, according to prior art.
Figure 2:
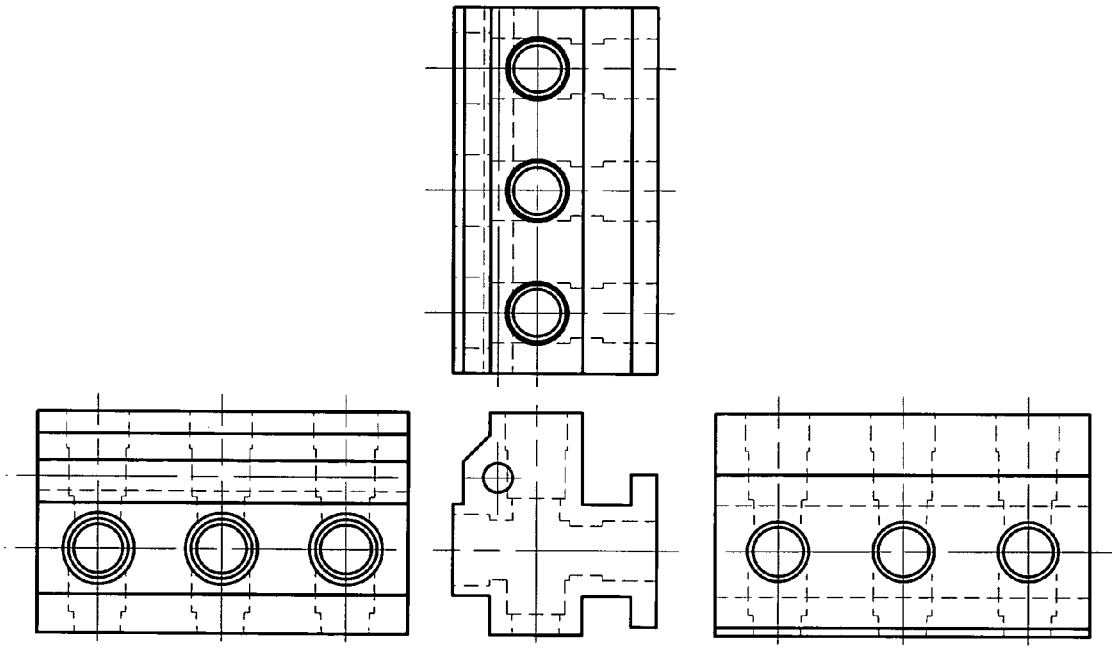
Prior Art Figure 2
FIG. 2 schematically illustrates a conventional Triplex plunger pump fluid section housing, according to prior art.
Figure 3:
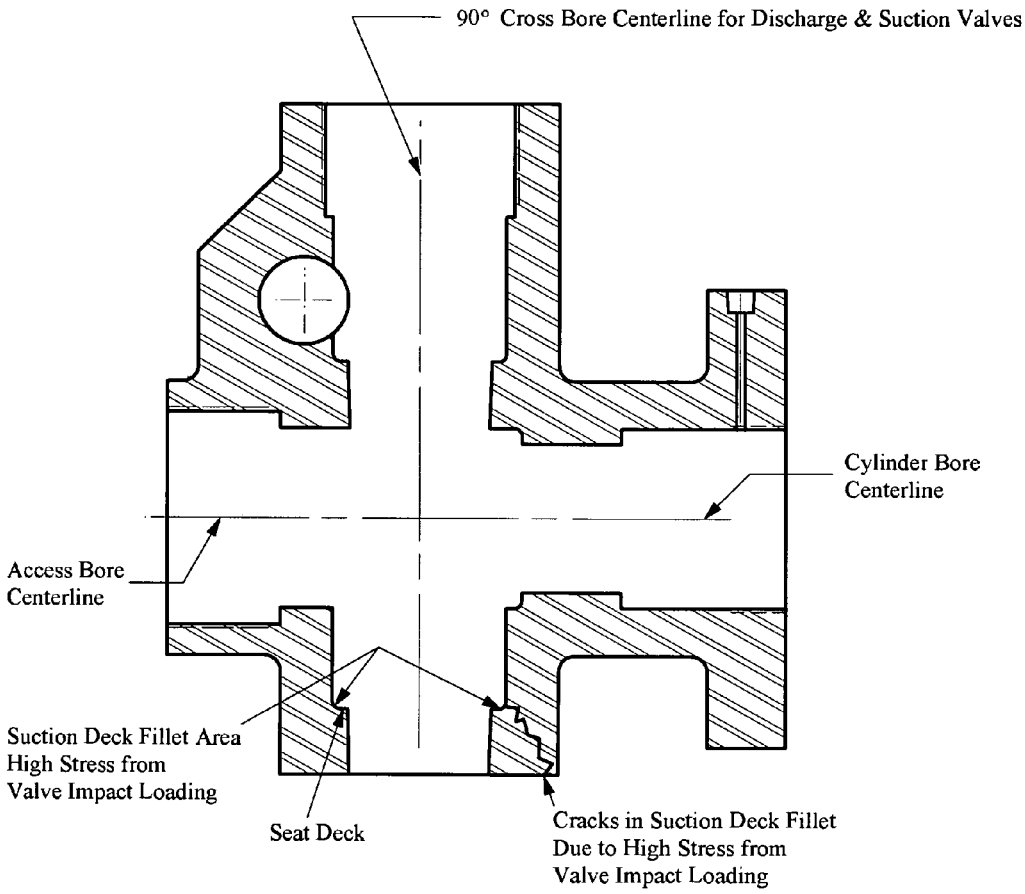
Prior Art Figure 3
FIG. 3 is a cross-sectional schematic view of suction, plunger, access and discharge bores of a conventional plunger pump housing intersecting at right angles and showing areas of elevated stress, according to prior art.

Moreover, the overall length L1 of tapered wall portions 31 are greater than the overall length L2 of the valve seat (FIG. 8B, FIG. 10) that is disposed therein according to the disclosure. Such features provide complete fitment of valve seats within a tapered region present within a bore 3, 5. Such features, including the degree of taper and within the ranges thereof specified herein, provide for elimination of regions of high stress in areas immediately above the suction valve seat that are prone to failure in a pump housing 12 as shown by crack in FIG. 3. In prior art structures, a region of high stress is the shoulder area in the fluid end at the bottom of the suction valve chamber. The suction valve seat engages a taper below this chamber, and a shoulder on the seat mates with the previously-described shoulder in the fluid end, which is sometimes referred to as the seat deck. High stress is concentrated in the fillet between the seat deck and the cylindrical inner diameter walls of the suction seat chamber, and cracks and clued end failure result, as shown in FIG. 3. The propensity for cracks and fluid end failure that often results from stress in the suction seat deck and fillet is due to the valve impact loads, is described in U.S. Pat. Nos. 5,249,600 and 7,070,166, (the entire contents of which are herein incorporated by reference thereto). It is the impact load of the valve against the seat which is then transmitted through the seat to the fluid end deck depicted in FIG. 3, resulting in high stress and cracking failure in the small fillet also depicted in FIG. 3. Features provided for a plunger pump and plunger pump housing herein eliminate the need for any shoulder portion to be present in a plunger pump housing at the bottom of the suction valve chamber, thus eliminating the concentrated high stress in the fillet between the seat deck and the cylindrical inner diameter walls of the suction seat chamber.

Thus, the present disclosure in some embodiments provides plunger-type pumps and housings ("fluid end blocks") therefor which are devoid of a shoulder or seat deck as a supportive feature of the suction valve and seat. The present disclosure in some embodiments also provides plunger-type pumps and housings therefor which have no small fillet in the side wall of the suction valve chamber 33 and discharge valve chamber 34 (FIG. 7), as a supportive feature of the suction valve and discharge valve respectfully.

As mentioned, any degree of taper within the range of about 2.000 inches per foot and 2.500 inches per foot, including 2.000 inches per foot and 2.500 inches per foot, and including all degrees of taper and ranges of degrees of taper therebetween, are suitable as taper dimensions of a portion of the suction bore 3 and discharge bore 5 in which a valve seat is to be disposed. Correspondingly, the valve seat outer wall 29 is also tapered, having a degree of taper that can be expressed in terms of inches of taper per length L2 (FIG. 8). Generally, the degree of taper of the valve seat outer wall 29 is identical to the taper present in bore 3, 5 in order to enable seat 15, 19 to seat firmly in bore 3, 5. In some embodiments a deviation of difference in degree of taper between a region within the interior of bore 3, 5 and outer wall 29 of seat 15, 19 is less than 0.0004 inches per inch of seat length L2. In some embodiments, the length L2 is about two inches.

Figure 8A:
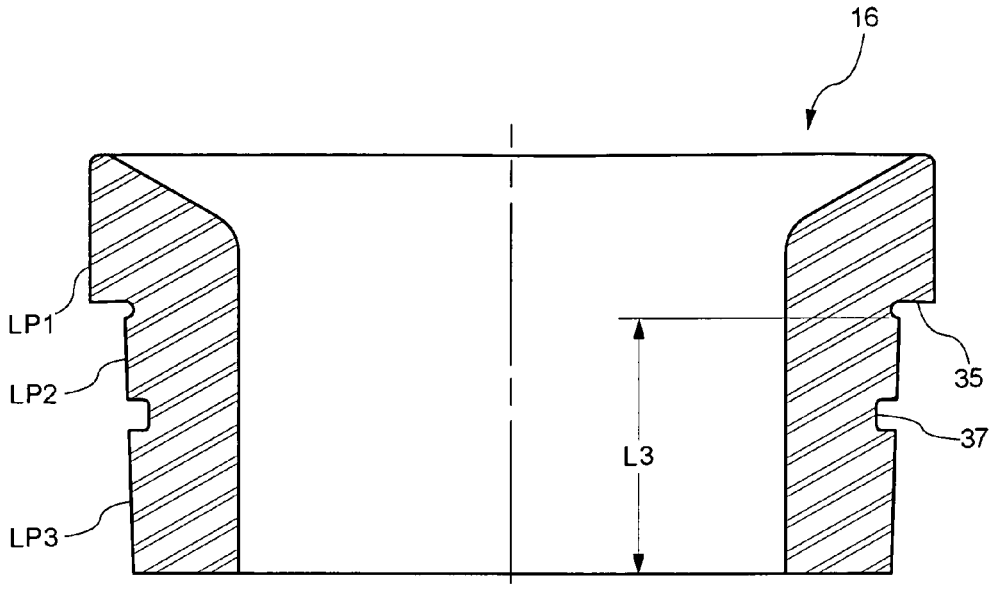
Figure 8A (PRIOR ART)
FIG. 8A is a cross-sectional view of a valve seat useful in a plunger pump housing according to the prior art.

In FIG. 8A is shown a cross-sectional view of a standard or conventional valve seat 16 useful in a plunger pump housing according to the prior art, illustrating such features as annular shoulder 35 and annular groove 37. The linear portions LP1 of outer wall of conventional seat 16 is cylindrical, whilst LP2, LP3 of outer wall of conventional seat 16 are substantially tapered, featuring a degree of taper of about 0.75 inches per foot of length L3 of the conventional seat 16. Historically, an o-ring is inserted in groove 37, which served as a backup seal in the event the seal on the taper failed. Modern machining and grinding tolerances eliminate the need for the back-up O-Ring seal.

Figure 8B:
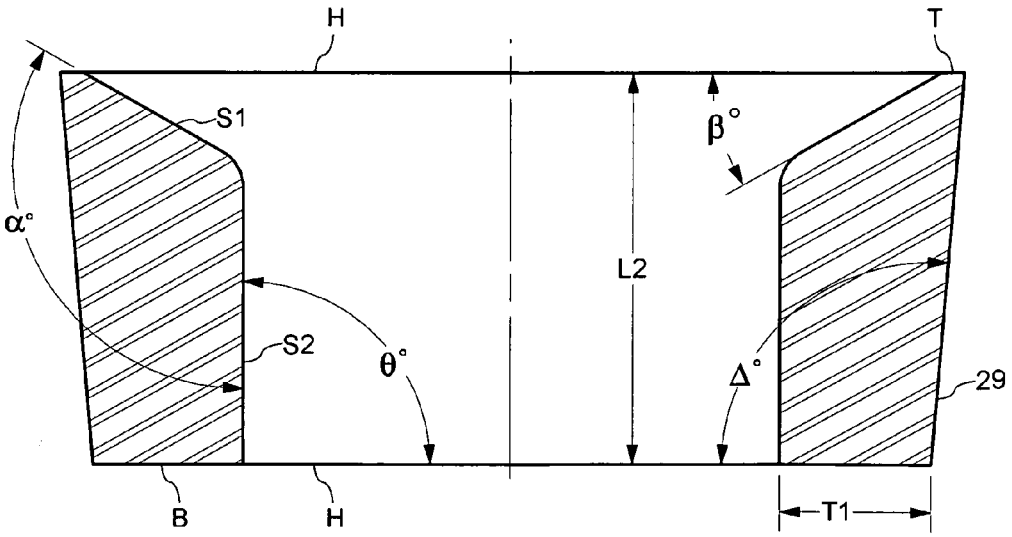
FIG. 8B is a cross-sectional view of a valve seat useful in a plunger pump housing according to some embodiments of the disclosure.

FIG. 8B depicts a cross-sectional view of a valve seat suitable for placement as 15, 19 (FIG. 6) in a plunger pump housing 12 according to embodiments of this disclosure. Valve seat outer wall 29 is seen to be tapered along its length L2 in any amount within the range of between 2.000 inches per foot and 2.500 inches per foot, including all degrees of taper and ranges of degrees of taper therebetween, as previously described. There is a seat surface S1 which is where a seal is made when a valve such as 13, 17 (FIG. 6) is in its closed position. There is also an inner wall S2 and also a wall thickness T1. Wall thickness in some embodiments is typically 0.70 inches thick, however, any wall thickness in the range of between 0.40 inches and 1.0 inches, including those values and all thicknesses and ranges of thicknesses therebetween are suitable. The seat in FIG. 8B also has a top T and a bottom B. In some embodiments of the disclosure, a valve seat having a continuous taper on its outer wall 29 is disposed in a bore in a fluid end block or housing that itself has at least one bore featuring a continuous taper, such that both the top and bottom of the seat are disposed entirely within a single tapered region within a bore such as 3, 5. In some embodiments the continuous taper within bore 3, 5 in which the seat is disposed is longer than L2 and extends in some embodiments beyond top T of the valve seat. In some embodiments the continuous taper within bore 3, 5 in which the seat is disposed is longer than L2 and extends below the bottom B of the valve seat. In some embodiments the continuous taper within bore 3, 5 in which the seat is disposed is longer than L2 and extends both beyond top T of the valve seat and below the bottom B of the valve seat. In some embodiments, the continuous taper within bore 3, 5 in which the seat is disposed begins at the top T of the valve seat. In some embodiments, the continuous taper within bore 3, 5 in which the seat is disposed begins above the top T of the valve seat. FIG. 8B also shows angle alpha α, which is the angle at which surfaces S1, S2 would intersect, were their linear surfaces extended. Also shown in FIG. 8B are angles beta, theta, and delta which relate to the geometry of a valve seat according to this disclosure in its various embodiments. Angle beta 1 is the angle that surface S1 makes with the horizontal H, angle theta 9 is the angle that inner wall surface S2 makes with the horizontal H, and angle delta Δ, is the angle that the valve seat outer wall 29 makes with the horizontal H. In some embodiments, angle alpha α minus angle theta θ minus angle beta β equals zero, and angle theta θ is 90 degrees. Angle alpha α can be any angle between about 100 degrees and 140 degrees, including these angles, and all angles and ranges of angles therebetween. In some embodiments, angle beta β can be any angle between about 25 degrees and 45 degrees, including these angles, and all angles and ranges of angles therebetween. In some embodiments, angle delta Δ is any angle between 94.764 degrees and 95.947 degrees, including these angles and all angles and ranges of angles therebetween. In some embodiments, angle theta θ is about 90 degrees, angle delta Δ is any angle between 94.764 degrees and 95.947 degrees, including these angles and all angles and ranges of angles therebetween, and the sum of angle alpha α and angle beta β is independently any angle value in the range of between about 100 and 170, including all angle values and ranges of angle values therebetween. In one non-limiting exemplary embodiment, angle alpha α is about 120 degrees, angle beta β is about 30 degrees, angle theta θ is about 90 degrees, and angle delta Δ is about 95 degrees.

Figure 9:
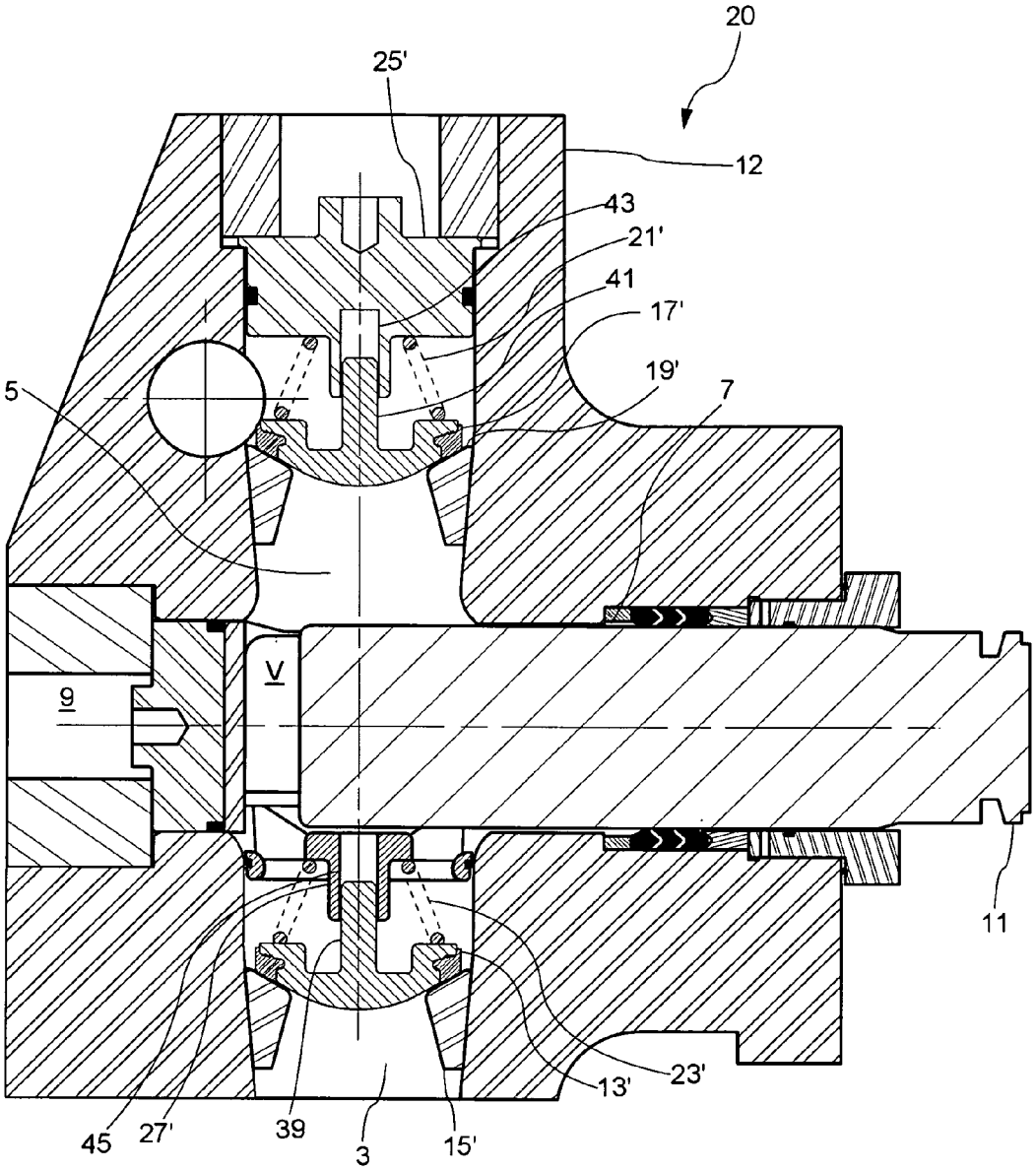
FIG. 9 schematically illustrates a cross-section of a right-angular plunger pump with valves, plunger in accordance with some embodiments of the disclosure.
Figure 10:
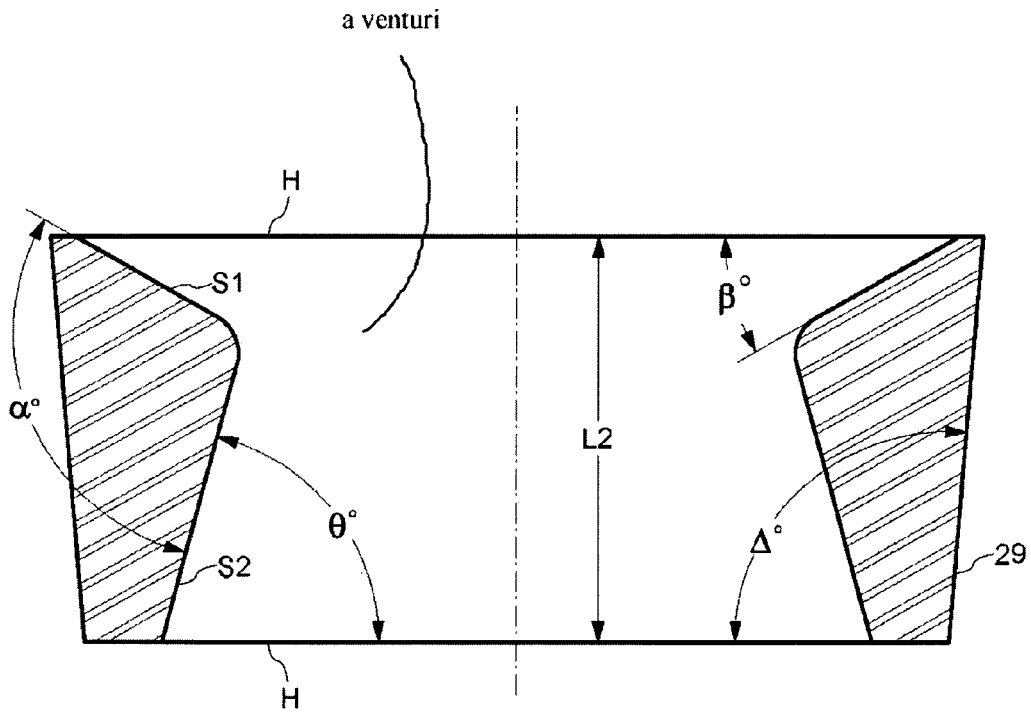
FIG. 10 is a cross-sectional view of a valve seat useful in a plunger pump housing according to some embodiments of the disclosure.

FIG. 9 shows a cross-section of a right-angular plunger pump 20 according to the disclosure, having suction bore 3, discharge bore 5, access bore 9 suction valve 13, seat 15, discharge valve 17, seat 19, plunger 11 present in a plunger bore, inner volume V, suction valve spring 23, suction valve spring retainer 27, discharge valve spring 21, discharge cover and spring retainer 25 according to some embodiments of the disclosure. FIG. 9 shows the versatility of this disclosure, featuring valves 13, 17 each having top stems 39, 41 respectively (stem-guided valves), which respectively are moveably disposed within stem guide bores 43, 45 the guide bores 43, 45 being an integral feature of spring retainers 25, 27. Thus, tapered regions within bores 3, 5 suitable for containing seats 15, 19 are seen to be useful in housings for plunger pumps having a variety of different types of valves 13, 17 and the present disclosure is useful with any internal valve component structures, A side cutaway view of an alternate configuration of a seat useful herein is shown in FIG. 10, having a length L2, seat surface S1, and inner wall S2. In some embodiments, the geometries of the surface of inner wall S2 and the seat surface S1 are configured so that if extended, they would intersect to form an angle alpha α, which angle α can be any angle in the range of between 90 degrees and 140 degrees, including all angles and ranges of angles therebetween. Such geometries cause a venturi to be formed, which enables improved flow characteristics over the configuration depicted in FIG. 8B.

Also shown in FIG. 10 are angles beta β, theta θ, and delta Δ which relate to the geometry of a valve seat according to this disclosure in its various embodiments. As previously specified, angle beta β is the angle that surface S1 makes with the horizontal H, angle theta θ is the angle that inner wall surface S2 makes with the horizontal H, and angle delta Δ, is the angle that the valve seat outer wall 29 makes with the horizontal H. In some embodiments, angle alpha α minus angle theta θ minus angle beta β equals zero, and angle theta θ is any angle between 55 degrees and 90 degrees, including all angles and ranges of angles therebetween. In some embodiments, angle alpha α can be any angle between about 90 degrees and 140 degrees, including these angles, and all angles and ranges of angles therebetween. In some embodiments, angle beta β can be any angle between about 25 degrees and 45 degrees, including these angles, and all angles and ranges of angles therebetween. In some embodiments, angle delta Δ is any angle between 94.764 degrees and 95.947 degrees, including these angles and all angles and ranges of angles therebetween. In some embodiments, angle theta θ is about 75 degrees, angle delta Δ is any angle between 94.764 degrees and 95.947 degrees, including these angles and all angles and ranges of angles therebetween, and the sum of angle alpha α and angle beta β is independently any angle value in the range of between about 100 and 150, including all angle values and ranges of angle values therebetween. In one non-limiting exemplary embodiment, angle alpha α is about 105 degrees, angle beta β is about 32 degrees, angle theta θ is about 74 degrees, and angle delta Δ is about 95 degrees.

Figure 4A:
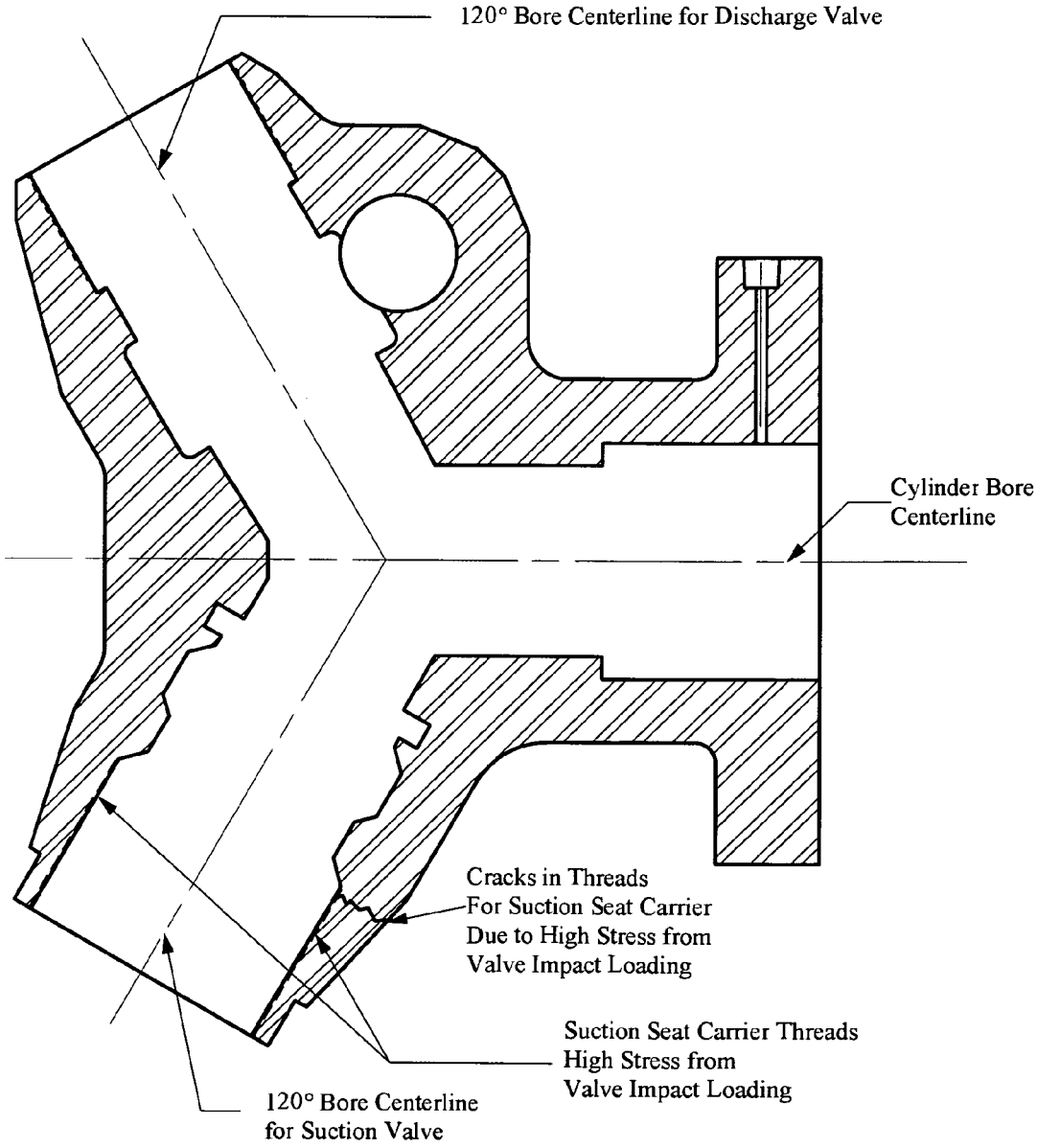
Prior Art Figure 4A
FIG. 4A is a cross-sectional schematic view of suction, plunger, and discharge bores of a Y-block plunger pump housing intersecting at obtuse angles showing areas of elevated stress, according to prior art.
Figure 4B:
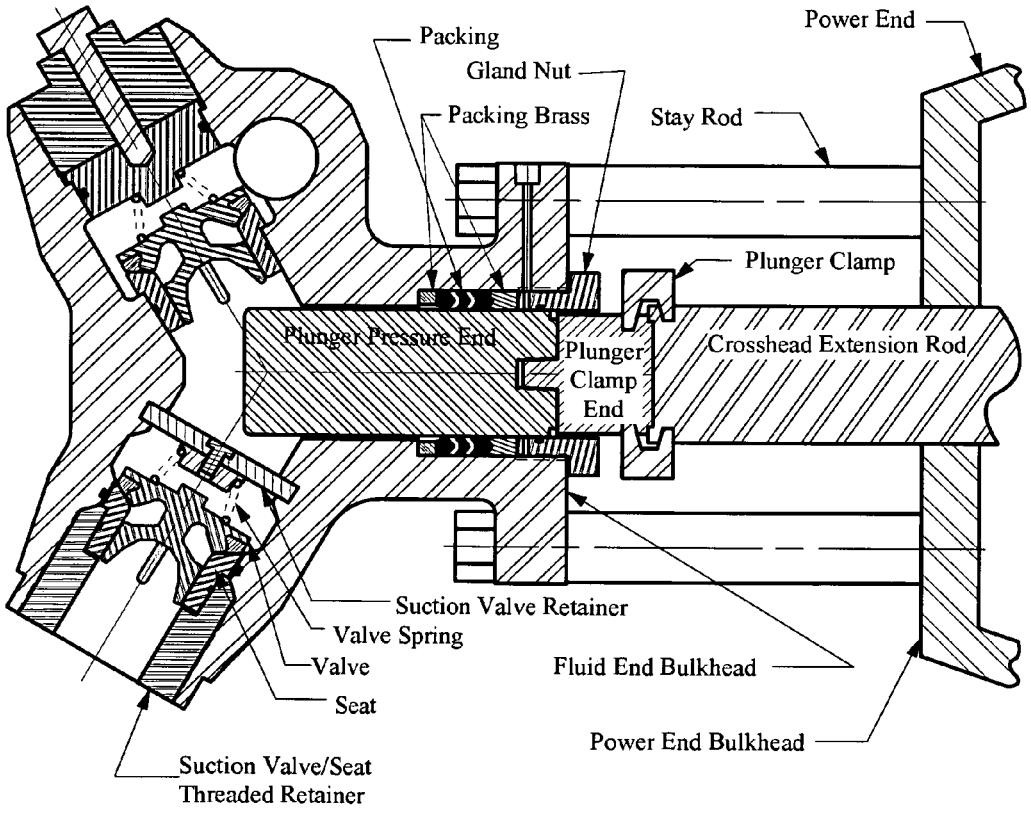
Prior Art Figure 4B
FIG. 4B is a cross-sectional schematic view of a Y-block plunger pump section having suction, plunger, and discharge bores that intersect at obtuse angles, according to prior art.
Figure 5:
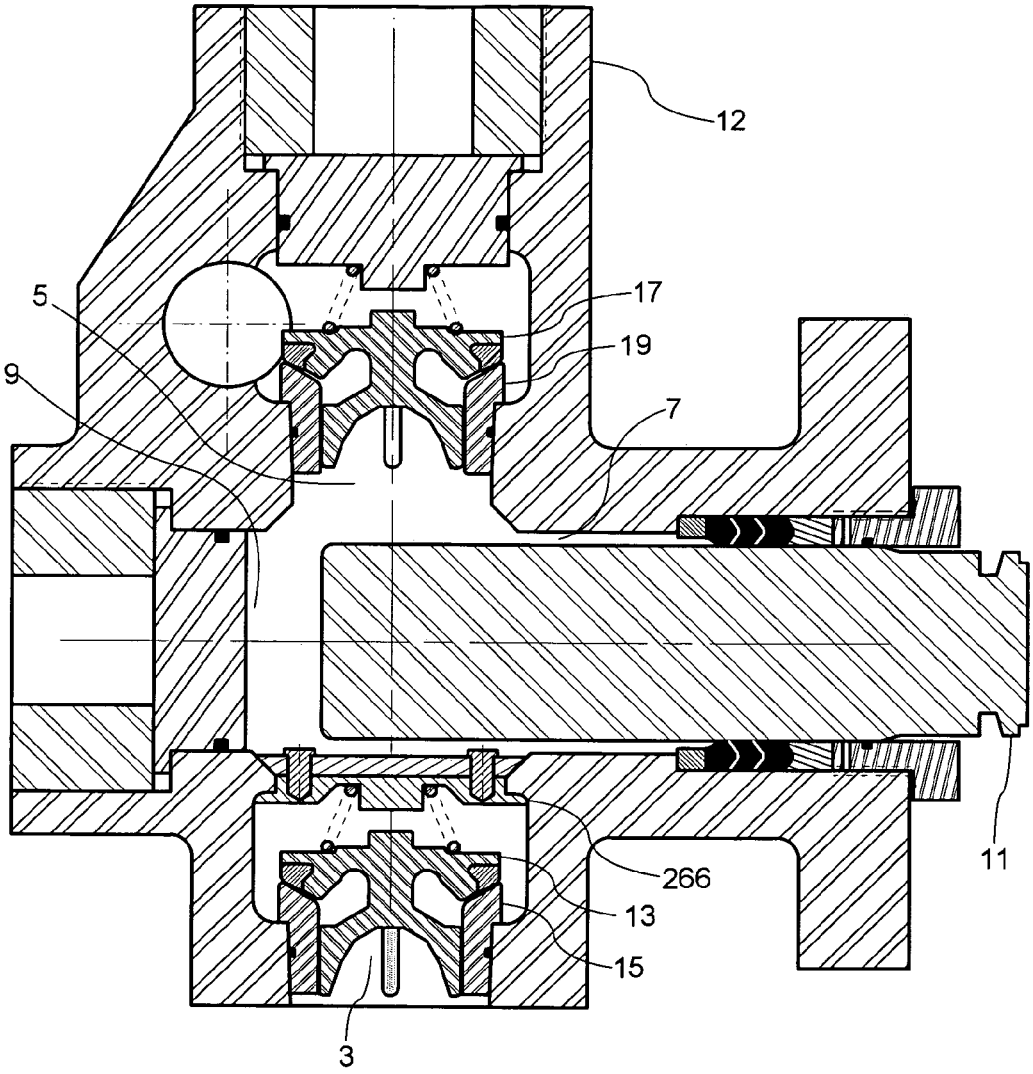
Prior Art Figure 5
FIG. 5 schematically illustrates a cross-section of a right-angular plunger pump with valves, plunger, and a suction valve spring retainer clamped about a lip of the housing, according to prior art.

Tapered seats and tapered regions present in a fluid end block provided according to this disclosure greatly reduce stress at the location above which the valve seats reside within the fluid end block and/or regions surrounding the location at which the valve seats reside within the fluid end block, in comparison to conventional designs exemplified in FIGS. 3, 4A. Tungsten carbide is a material of very high hardness and durability, however, valve seats employed in the types of pumps described herein of the prior art have not yet in the art been comprised of tungsten carbide, owing to its brittleness and the presence of high stresses on the shoulder portion of valve seats configured as provided by the prior art. The configurations provided herein enable the use of seat materials that provide far greater wear resistance than heat treated hardened steel. Such materials include tungsten carbide, which, while very brittle, would tend to have a service life of about three times or greater than that of conventional seats. The brittleness of tungsten carbide in general renders it unsuitable for conventional seats configurations of FIG. 8A because of their complex geometry, and particularly owing to the presence of the internal corners. Conversely, the simple seat geometry demonstrated in FIG. 8B and provided by this disclosure enables the use of brittle materials such as tungsten carbide, particularly when the entire outside seat taper is captured or contained by the corresponding taper in the fluid end block, as shown in FIGS. 6 and 9. Valve seat wear failure times of about 10 to 100 operating hours are typical when using conventional seats of heat treated carbon steel.

The structures provided by this disclosure therefore represent a significant advance in the art by facilitating the use of tungsten carbide seats as well as reducing fluid end block stress and thus increasing fluid end block life. Due to the significantly greater wear resistance of tungsten carbide, such seats will provide an increase in service life over three-fold that of prior art seats.

The modulus of elasticity of tungsten carbide is approximately 2.5 times that of steel, and accordingly a seat and bore as provided herein for a fluid end cannot contract when forced deeply into a tapered bore under extreme loads. The structures provided herein totally eliminate the need for a seat shoulder or a corresponding shoulder at the bottom end of the fluid end taper.

The configurations provided by the present disclosure support the use of valve seats made using conventional valve seat materials, including carbon steel. The configurations provided by the present disclosure also support the use of valve seats made from materials other than conventional valve seat materials and tungsten carbide, including without limitation: silicon carbide, vanadium carbide, titanium carbide, molybdenum carbide and chromium carbide, including any mixtures or alloys of any of the foregoing with one another and any mixtures or alloys of any of the foregoing with conventional materials from which valve seats are made, including iron and steels. In some embodiments of this disclosure, a fluid end assembly is provided wherein the material from which at least one of the valve seats is comprised or made has a modulus of elasticity (Young's Modulus) greater than about 30,000,000 psi. In some embodiments of this disclosure, a fluid end assembly is provided wherein the material from which at least one of the valve seats is comprised or made has a modulus of elasticity (Young's Modulus) of any value in the range of between 65,000,000 psi and 94,000,000 psi, including all values of psi (pounds per square inch) therebetween, and all ranges of psi therebetween. Such materials being either isotropic, or anisotropic are within the scope of this disclosure.

Consideration must be given to the fact that although this invention has been described and disclosed in relation to certain preferred embodiments, equivalent modifications and alterations thereof may become apparent to persons of ordinary skill in this art after reading and understanding the teachings of this specification, drawings, and the claims appended hereto. The present disclosure includes subject matter defined by any combinations of any one or more of the features provided in this disclosure with any one or more of any other features provided in this disclosure. These combinations include the incorporation of the features and/or limitations of any dependent claim, singly or in combination with features and/or limitations of any one or more of the other dependent claims, with features and/or limitations of any one or more of the independent claims, with the remaining dependent claims in their original text being read and applied to any independent claims so modified. These combinations also include combination of the features and/or limitations of one or more of the independent claims with features and/or limitations of another independent claims to arrive at a modified independent claim, with the remaining dependent claims in their original text or as modified per the foregoing, being read and applied to any independent claim so modified. The present invention has been disclosed and claimed with the intent to cover modifications and alterations that achieve substantially the same result as herein taught using substantially the same or similar structures, being limited only by the scope of the claims which follow. The term "about" when used herein in reference to a numerical value, includes that numerical value to which it refers.

The invention claimed is:

1. A fluid end block useful for providing a plunger-type pump comprising a) a suction bore having an axis and comprising a suction valve chamber;

b) a discharge bore having an axis and comprising a discharge valve chamber;

c) a plunger bore, wherein at least one of said suction bore and said discharge bore includes a tapered inner wall portion having a length and a continuous taper of any degree in the range of between 2 inches per foot and 2.5 inches per foot; and d) a valve seat having a top and a bottom, disposed within said tapered inner wall, said valve seat having a tapered outer wall, and an overall length, wherein the taper of said tapered outer wall corresponds to the taper of said tapered inner wall sufficiently to enable said seat to reside within said tapered inner wall, the length of said tapered inner wall being greater than the length of said outer wall of said seat, and wherein the entire overall length of said outer wall of said seat resides entirely within said tapered inner wall.

2. A fluid end block according to claim 1 present in the configuration of a Y-block.

3. A fluid end block according to claim 1 present in the configuration of right-angular plunger pump, the suction bore and discharge bore substantially sharing a common centerline, wherein the centerline of said plunger bore is substantially perpendicular to the centerline of said suction bore and said discharge bore.

4. A fluid end block according to claim 1 wherein at least one of said suction bore and said discharge bore is devoid of any flat surface perpendicular to said axis of at least one of said suction bore and said discharge bore between said tapered inner wall and at least one of said suction valve chamber and said discharge valve chamber.

5. A fluid end block according to claim 1 wherein said suction valve chamber comprises a substantially cylindrically-shaped bore portion adjacent to said tapered inner wall, said suction bore including a transition between said tapered inner wall portion and said substantially cylindrically-shaped bore portion.

6. A fluid end block according to claim 5 further comprising: e) a valve disposed within said valve seat, said valve having a top portion and a bottom portion and wherein said transition between said tapered inner wall portion and said substantially cylindrically-shaped bore is disposed between said top of said valve and said top of said valve seat when said valve is in a closed position.

7. A fluid end block according to claim 6 wherein said tapered inner wall is of sufficient length that a portion of said valve is disposed within said substantially cylindrically shaped bore when said valve is in an open position.

8. A fluid end block according to claim 5 wherein the taper of the outer wall of said valve seat begins at the top of said valve seat.

9. A fluid end block according to claim 5 wherein said suction bore is devoid of any flat surface perpendicular to said axis of said suction bore between said tapered inner wall and said valve chamber.

10. A fluid end block according to claim 5 wherein said valve seat is comprised of a material selected from the group consisting of: silicon carbide, vanadium carbide, titanium carbide, molybdenum carbide, tungsten carbide, and chromium carbide, and steel.

11. A fluid end block according to claim 5, wherein said valve seat has an interior wall that is sufficiently contoured to provide a venturi.

12. A fluid end assembly comprising:

A) a fluid end block having:

i) a suction bore including a tapered inner wall portion having a region of continuous taper with a degree of taper of any degree in the range of between 2 inches per foot and 2.5 inches per foot, ii) a first valve seat having a top, a bottom, and a tapered outer wall, said tapered outer wall being substantially the same in taper as the tapered inner wall portion of said suction bore, said first valve seat being present in said region of continuous taper of said suction bore, said taper of said tapered outer wall of said first valve seat corresponding to the taper of said tapered inner wall of said suction bore sufficiently to enable said seat to reside within said tapered inner wall of said suction bore, said tapered inner wall of said suction bore extending above said top of said first valve seat, said tapered inner wall of said suction bore extending below said bottom of said first valve seat;

iii) a discharge bore including a tapered inner wall portion having a region of continuous taper with a degree of taper of any degree in the range of between 2 inches per foot and 2.5 inches per foot, iv) a second valve seat having a top, a bottom, and a tapered outer wall, said tapered outer wall being substantially the same in taper as the tapered inner wall portion of said discharge bore, said second valve seat being present in said region of continuous taper of said discharge bore, said taper of said tapered outer wall of said second valve seat corresponding to the taper of said tapered inner wall of said discharge bore sufficiently to enable said seat to reside within said tapered inner wall of said discharge bore, said tapered inner wall of said discharge bore extending above said top of said second valve seat, said tapered inner wall of said discharge bore extending below said bottom of said second valve seat;

iv) a plunger bore;

B) a plunger moveably disposed within said plunger bore;

C) a valve moveably disposed in said suction bore, and sealingly engageable with said seat present in said suction bore; and D) a valve moveably disposed in said discharge bore, and sealingly engageable with said seat present in said discharge bore.

13. A fluid end assembly according to claim 12 wherein at least one of said valve disposed in said discharge bore and valve disposed in said suction bore is a stem-guided valve.

14. A fluid end assembly according to claim 12 wherein at least one of said valve seats is comprised of a material selected from the group consisting of: silicon carbide, vanadium carbide, titanium carbide, molybdenum carbide, and chromium carbide, tungsten carbide, and steel.

15. A fluid end assembly according to claim 12, wherein at least one of said seats has an interior wall that is sufficiently contoured to provide a venturi.

16. A fluid end assembly according to claim 12 wherein the material from which at least one of said valve seats is comprised has a modulus of elasticity (Young's Modulus) greater than about 30,000,000 psi.

17. A fluid end assembly according to claim 12 wherein the material from which at least one of said valve seats is comprised has a modulus of elasticity (Young's Modulus) of any value in the range of between 65,000,000 psi and 94,000,000 psi.

18. A fluid end block useful for providing a plunger-type pump comprising a block having:

a) a suction bore having an axis and comprising a suction valve chamber;

b) a discharge bore having an axis;

c) a plunger bore, wherein at least one of said suction bore and said discharge bore includes a tapered inner wall portion having a length and a continuous taper of any degree in the range of between 2 inches per foot and 2.5 inches per foot; and d) a valve seat having a top and a bottom, disposed within said tapered inner wall, said valve seat having a tapered outer wall, and an overall length, wherein the taper of said tapered outer wall corresponds to the taper of said tapered inner wall sufficiently to enable said seat to reside within said tapered inner wall, the length of said tapered inner wall being greater than the length of said outer wall of said seat, and wherein the entire overall length of said outer wall of said seat resides entirely within said tapered inner wall, wherein said suction valve chamber comprises a substantially cylindrically-shaped bore portion adjacent to said tapered inner wall, said suction bore including a transition between said tapered inner wall portion and said substantially cylindrically-shaped bore portion, said suction bore being devoid of any flat surface perpendicular to said axis of said suction bore between said tapered inner wall and said valve chamber.

19. A fluid end block according to claim 18, further comprising:

e) a valve disposed within said valve seat, said valve having a top portion and a bottom portion and wherein said transition between said tapered inner wall portion and said substantially cylindrically-shaped bore is disposed between said top of said valve and said top of said valve seat when said valve is in a closed position.

* * * * *